US005862725A

United States Patent [19]

Negus

[11] Patent Number: 5,862,725

[45] Date of Patent: Jan. 26, 1999

[54] ANTENNA NUT SOCKET

[75] Inventor: Joel A. Negus, Clarinda, Iowa

[73] Assignee: Lisle Corporation, Clarinda, Iowa

[21] Appl. No.: 938,433

[22] Filed: Sep. 26, 1997

Related U.S. Application Data

[63] Continuation of Ser. No. 634,172, Apr. 18, 1996, abandoned.

[51] Int. Cl.[6] ..... B25B 23/00

[52] U.S. Cl. ..... 81/461; 81/124.3

[58] Field of Search ..... 81/461, 176.1, 81/176.15, 176.2, 121.1, 124.2, 124.3, 124.4, 124.7, 125.1

[56] References Cited

U.S. PATENT DOCUMENTS

| | | | |
|---|---|---|---|
| 810,599 | 1/1906 | Ansorge | 81/24.3 X |
| 1,778,576 | 10/1930 | Walker | 81/124.3 X |
| 4,084,454 | 4/1978 | Day | 81/124.7 |
| 4,096,896 | 6/1978 | Engel | 81/438 X |
| 4,189,976 | 2/1980 | Becker | 81/124.3 X |
| 4,848,197 | 7/1989 | Kukel | 81/438 X |
| 5,048,379 | 9/1991 | Gramera et al. | 81/121.1 X |
| 5,216,941 | 6/1993 | Kolvereid | 81/461 |
| 5,295,422 | 3/1994 | Chow | 81/124.3 |
| 5,438,894 | 8/1995 | Pearce | 81/124.2 X |
| 5,481,949 | 1/1996 | Yen | 81/438 |
| 5,542,321 | 8/1996 | Fuca | 81/124.2 X |

*Primary Examiner*—D. S. Meislin
*Attorney, Agent, or Firm*—Banner & Witcoff Ltd

[57] ABSTRACT

A double-ended socket for antenna nuts includes a central hexagonal body section separated into two parts by a flange. The socket further includes a collar with lugs extending axially from each end of the center body section.

3 Claims, 1 Drawing Sheet

ANTENNA NUT SOCKET

This is a continuation application Ser. No. 08/634,172, filed Apr. 18, 1996, now abandoned.

BACKGROUND OF THE INVENTION

This invention relates to a socket made especially for removal and replacement of vehicle antenna retention nuts.

Typically the antenna of a vehicle includes or utilizes a specially designed and constructed antenna nut to retain the antenna in position. Such a nut includes a circumferencial or circular pattern of recesses around the periphery of the nut so that a socket with compatible lugs may be fitted over the antenna and engaged with the nut recesses. Usually such sockets are of various diameters and include two, three or four prongs so as to be compatible with variously sized and configured antenna nuts. The sockets also typically include a hexagonal driver or lug at the end opposite the lugs. Since antennas very significantly in size and shape, there are many different sizes of antenna nuts and many different configurations of recess patterns in such nuts. Thus, heretofore, an individual or unique socket has been required for each unique antenna nut. This has made it necessary for vehicle repair shops to have a collection of at leaset six antenna sockets, which are costly and may be misplaced or lost.

It is against this background that applicant developed an antenna nut socket construction which is less expensive and which enables reduction of the inventory of sockets by one-half relative to known prior art antenna sockets.

SUMMARY OF THE INVENTION

Briefly, the present invention comprises an antenna nut socket which includes a unitary double-ended body having a hexagonal center section divided into two parts separated by a flange. A cylindrical collar extendes axially on each side of the center section, and each collar includes projecting lugs adapted to engage the recesses of a particular compatible antenna nut. The antenna nut socket includes a throughbore so that it may be guided over an antenna and the lugs subsequently engaged into socket recesses. Thus, either end of the socket may be engaged with an appropriate antenna nut. Since each socket is doubled-ended, the necessity for separate sockets is reduced by one-half. The center hexagonal section is separated by a flange which insures that a wrench used with the socket will not slip axially and will enable the operator of the socket to maintain the lugs in the recesses and thereby impart a rotational motion to remove or insert the antenna nut.

Thus, it is an object of the invention to provide an improved antenna nut socket.

It is a further object of the invention to provide an improved antenna nut socket which is economical to manufacture and which may be used with multiple sizes of antenna nuts.

Yet a further object of the invention is to provide a unitary, double-ended antenna nut socket thereby reducing by one-half the necessary inventory of sockets for antenna nuts.

Another object of the invention is to provide an antenna nut socket which may be easily positioned over an antenna and then engaged with an antenna nut.

A further object of the invention is to provide an antenna nut socket which includes means to prevent axial slippage of a wrench on the socket when turning the socket.

These and other objects, advantages and features of the invention will be set forth in the detailed description which follows.

BRIEF DESCRIPTION OF THE DRAWING

In the detailed description which follows reference will be made to the drawing comprised of the following FIGURES.

DETAILED DESCRIPTION OF THE PREFERRED EMBODIMENT

Figure 1:
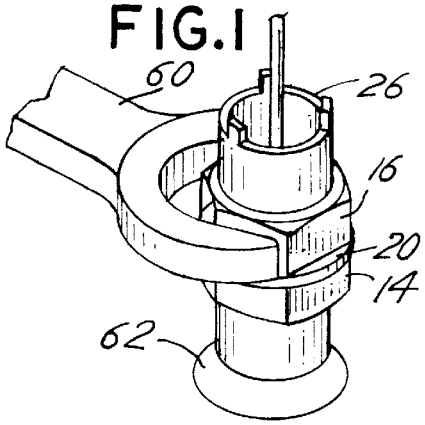
FIG. 1 is an isometric view of the antenna nut socket of the invention positioned to remove a nut.
Figure 1A:
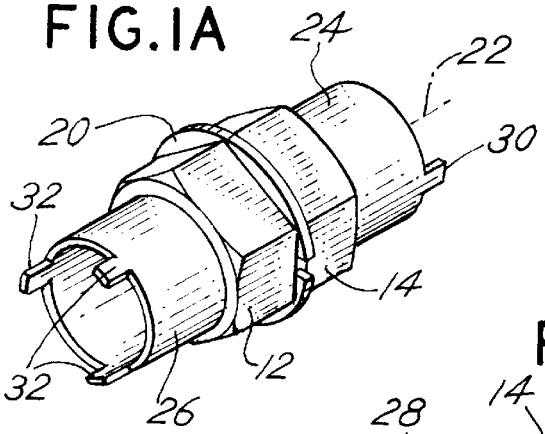
FIG. 1A is an isometric view of the antenna nut socket of the invention.
Figure 2:
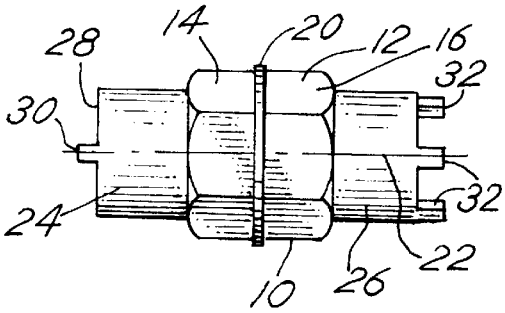
FIG. 2 is a plan view of an antenna nut socket of the invention.
Figure 3:
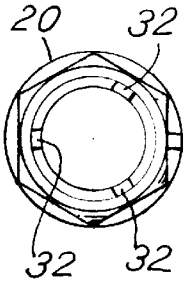
FIG. 3 is an end view of the socket of FIG. 2.
Figure 4:
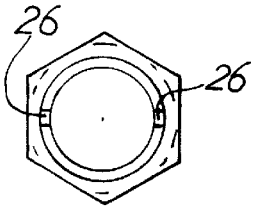
FIG. 4 is an end view of the opposite end of the socket of FIG. 2.

The antenna nut socket of the invention is a double-ended socket with a medial flange separating the ends. Thus, as depicted in FIGS. 1A, 2–7 the socket includes a socket body 10 with a hexagonal profile or cross section, center section 12. The center section is divided into a first part 14 and a second part 16. The parts 14 and 16 are axially separated one from the other by a circumferencial slot 18 which receives a split ring 20 defining a medial flange. The socket body 10 defines a center line axis 22, and the parts 14 and 16 are co-axial and centered on the axis 22.

Extending in opposite directions from the first and second parts 14 and 16, respectively, are first and second collars 24 and 26. The collars 24, 26 are generally cylindrical and coaxial with axis 22. Each collar, for example, collar 24 includes axially, outwardly projecting lugs 30. Thus, collar 24 includes an outer rim 28 and two axially, outwardly projecting lugs 30. The lugs 30 are spaced at 180° from one another in the embodiment shown. The second collar 26 includes three axially, outwardly projecting lugs 32. The three lugs 32, are spaced at 120° from one another. The lugs 30 and 32 are thus arranged to be coactive with and compatible with appropriate antenna nuts.

Figure 5:
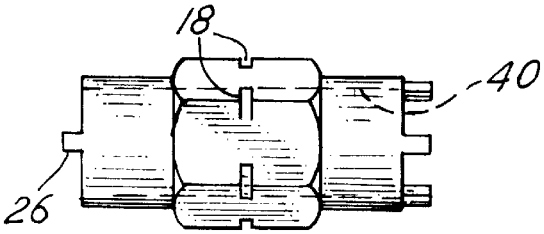
FIG. 5 is a plan view of the socket body of the socket of FIG. 2.

The body 10 includes a throughbore 40 as depicted in FIG. 5. The throughbore 40 may have a uniform diameter or may have a distinct diameter at each end associated with each collar 24 and 26. The internal dimensions of the throughbore 40 are thus associated with the diameter of the particular collar 24, 26 which, in turn, is associated with the size of the antenna nut which is to be acted upon by the lugs associated with that collar 24, 26.

Each socket is thus fabricated in a very straightforward manner. That is, hexagonal stock is cut to a desired socket length. The outside diameter of each collar 24, 26 is then machined at each end of the socket and a bore 40 of the desired diameter is drilled from each opposite end at least through to the midpoint of the socket. The collars 24, 26 are then further machined to reveal or define the axially extending prongs or lugs 30, 32. The circumferencial slit 18 is cut or machined in the hexagonal stock. A separate C-ring or split ring 20 is then positioned in the slit 18 to define a medial flange.

Figure 6:
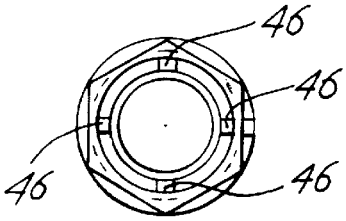
FIG. 6 is an end view of a socket body of different size and lug configuration.
Figure 7:
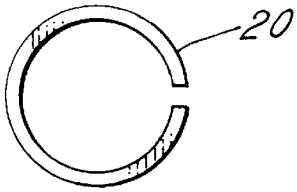
FIG. 7 is a plan view of the ring or flange which is incorporated with and attached to the socket body of FIG. 5 so as to provide the socket of FIG. 2.

As shown in FIG. 6, additional lugs such as four lugs 46 may be defined or machined. Again, the determination of the number of lugs and the diameter of the collar on the inside and outside surface thereof is dependent upon the antenna nuts with which the socket is to be used.

In use, the socket is positioned over an antenna and then the lugs are engaged with the recesses in the antenna nut. As depicted in FIG. 1, a wrench 60 is placed on the hexagonal section 16 of the socket opposite the nut 62 or most distal from the nut 62 and manually actuated to rotate the socket and nut 62. The side surfaces of the wrench jaws impinge against the flange or ring 20 and thus are prevented from slipping off of the hexagonal section 12, especially when one provides an axial force on the socket against the antenna nut. Consequently, a plurality of functions are achieved by the flange 20 regardless of which end of the socket is engaged with an antenna nut 62.

The construction may be varied and still be within the scope of the invention. For example, the diameters of the collars, the array and arrangement of the lugs, the number of sides associated with the central body, the use of two spaced flanges to thereby capture wrench jaws therebetween and prevent slippage, and other variations may be effected. The invention is therefore limited only by the following claims and their equivalents.

What is claimed is:

1. An antenna nut socket comprising, in combination:

a unitary, double ended body, said body having a centerline axis and including a center section having a uniform polygonal profile along its entire axial length for receipt of a wrench, said center section divided into first and second axially adjacent parts with a single, separate radial flange separating the first and second parts, the first and second parts each providing a separate wrench receiving portion of the center section, said first and second parts defined and separated by a single circumferential slot in the outer surface of the polygonal center section, said flange comprising a separate, solid split ring washer in the slot for engaging and limiting axial movement of a wrench on a wrench receiving portion, said body further including first and second collars extending respectively in axially opposite directions from the first and second parts, each of said collars including an outer rim with an array of axially extending lugs positioned about the outer rim, said lugs arrayed for engagement with an antenna nut, said collars and polygonal section being coaxial, said lugs being generally parallel to the axis, said body including an axial throughbore of uniform diameter extending entirely through the body, coaxial with the center section and collars, and sized for passage of an antenna therethrough, said lugs of each collar engageable with an antenna lug nut whereby the body may be rotated and simultaneously directed axially towards said antenna nut by engaging a single wrench with the polygonal profile center section and flange simultaneously, said hexagonal center section being thereby rotatable about the axis as the flange is engaged to direct the socket axially toward the antenna nut.

2. The socket of claim 1 wherein each collar has a unique outside diameter and lugs associated with a distinct size of an antenna nut.

3. A method for removal or tightening of an antenna nut which retains an antenna comprising the steps of:

(a) providing a unitary, double ended socket wherein said socket has a body with an axis and an axial, uniform diameter throughbore, said body including a center section having a polygonal profile for receipt of a wrench, said center section divided into first and second axially adjacent parts with a single, solid radial flange separating the first and second parts whereby the first and second parts each provide a separate wrench receiving portion of the center section, said first and second parts defined and separated by a circumferential slot in the outer surface of the center section, said flange comprising a separate, solid split ring washer in the slot for limiting axial movement of a wrench on the wrench receiving portion, said body further including first and second collars extending in axially opposite directions from the first and second parts, respectively, each of said collars including an outer rim with an array of axially extending lugs positioned about the outer rim, said lugs arrayed for engagement with an antenna nut, said collars, throughbore and polygonal section being coaxial, said lugs being generally parallel to the axis;

(b) positioning said body axial throughbore over the antenna and engaging the lugs of said collar at one end of said socket with the antenna lug nut;

(c) positioning a wrench on the polygonal profile; and (d) rotating the wrench and simultaneously directing the wrench positioned on the polygonal profile axially toward the antenna nut and the flange to thereby simultaneously engage and rotate said antenna nut.

* * * * *